United States Patent [19]

Lee

[11] Patent Number: 5,055,033

[45] Date of Patent: Oct. 8, 1991

[54] LIGHTER DEVICE

[76] Inventor: Shan Lee, No. 53, Luen Teng St., Shih Lin Area, Taipei, Taiwan

[21] Appl. No.: 599,921

[22] Filed: Oct. 19, 1990

[51] Int. Cl.[5] ..... F23Q 7/12

[52] U.S. Cl. ..... 431/255; 431/268; 431/277

[58] Field of Search ..... 431/255, 276, 277, 344, 431/254, 268

[56] References Cited

U.S. PATENT DOCUMENTS

| | | | |
|---|---|---|---|
| 3,493,313 | 2/1970 | Schlamp | 431/255 |
| 3,814,572 | 6/1974 | Nitta | 431/276 |
| 4,906,179 | 3/1990 | Nitta | 431/255 |
| 4,929,174 | 5/1990 | Wang | 431/276 |
| 4,941,818 | 7/1990 | Ohe et al. | 431/268 |

*Primary Examiner*—Carroll B. Dority
*Attorney, Agent, or Firm*—Varndell Legal Group

[57] ABSTRACT

A lighter device is described featuring a new burning system which is of a rugged structure and comprises relatively few parts which are easy to manufacture and to assemble. The novel burning system provides for reliable operation of the device over an extended period of operable life. The novel burning system comprises combined vaporizer-and-burner unit in the form of a short metal tube arrangement comprising two sections of metal tube axially aligned with one another. The upper section may have a larger diameter than the lower section. The combined vaporizer-and-burner unit is arranged as a separate member separately from and above the nozzle in a predetermined vertical distance therefrom. A perforated metal sheet partitions the two tube sections of the vaporizer-and-burner unit thus providing for additional intensive mixing and vaporizing the gas stream entering at the lower end of the unit and ambient air drawn into the unit by the gas jet. In the upper section of the vaporizer-and-burner unit there is a catalyzer wire which will provide for re-ignition of the gas/air mixture in case the lighter flame would become extinguished by ambient wind flow.

9 Claims, 2 Drawing Sheets

LIGHTER DEVICE

BACKGROUND THE INVENTION

The invention relates to lighter devices of the well-known type wherein on actuation thereof a jet of a suitable fuel such as pressurized liquid butane gas will flow out from a nozzle-valve unit and will contact ignition sparks simultaneously generated by an associated ignition system whereby to provide a burning flame, e.g. for lighting tobacco products such as cigarettes or cigars.

Presently, there are essentially two main types of such butane gas lighter, namely low standard disposable butane lighters (one way gas lighters), and high quality wind-proof butane lighters.

Of these, the former type (low standard disposable butane lighters) have the following two main deficiencies: In the actuated condition the flame burns directly on top of the nozzle from which the fuel flows out, thereby directly heating the nozzle parts and tending to impair and ultimately destroy the rubber O-ring and rubber nail inside the nozzle-valve unit for controlling the butane gas flow. While this impairment of the nozzle parts may be tolerable to a certain degree in a disposable (one way) cheap lighter, it would obviously unduly limit the useful life of a better quality lighter device. Even in the low cost disposable devices, this direct heating of the nozzle by the flame unduly limits the admissible strength of the flame to a very weak flame. This in turn causes the second deficiency of this type of lighter, namely its inherent lack of wind-proof characteristics inasmuch the weak flame is undesirably subject to extinction by even light ambient wind.

Regarding the other main type, namely high quality wind-proof butane lighters, they suffer substantially from three deficiencies. While in this type a special burning chamber in the form of a short metal tube is provided distant from the nozzle, this short metal tube is directly connected with the nozzle through a long pipe to guide the butane from the the nozzle to the short metal tube serving as the burning space. Inside said long connecting tube there is a rubber layer for providing flexibility to the arrangement whereby to maintain the connection between the burning space and the nozzle. Further connection parts are required for providing connection between the burning space (short metal tube), the long connection pipe and the nozzle and valve unit. On actuation of the lighter, the flame will burn right on top of the long connection pipe. Thus, the long pipe will be directly heated by the flame burning on top of it which tends to impair and damage the rubber cladding on the inside of the connector pipe and other assembled parts. The long connector pipe also provides direct heat transfer between the flame and the nozzle, with a tendency of the latter also become (indirectly) heated by the lighter flame, with concomitant damage to the nozzle parts. These effects of undesired direct and indirect heating of the long pipe and the nozzle combine to unduly limit the useful operative life of the device. Further, the constituent parts of this burning system: short metal tube, long pipe, connection parts, nozzle and its controlling valve, have to be precision-assembled; precision assembly may be impaired by shock impact in use of the device, whereby the device might become inoperative, such as if the movable long pipe should lose its contact with the nozzle. Finally the larger number of constituent parts of this known burning system and the criticality of precisely assembling these parts obviously tend to undesirably increase the production cost of these devices.

SUMMARY OF THE INVENTION

The present invention relates to a lighter device of the general type comprising, a lower housing portion housing a fuel tank containing fuel under pressure, preferably pressurized butane liquid gas fuel, a nozzle-and-valve unit connected with said fuel tank and arranged to project from said lower housing portion towards a burning space provided in the upper portion of the lighter, a burning system comprising a tube-like burner member associated with and arranged above said nozzle-and-valve unit, an ignition system preferably mounted on the upper portion of the lighter and arranged to provide, on actuation thereof, ignition sparks to said burning space, actuating means for said valve of said nozzle-and-valve unit, for switching the valve from its normally closed condition into its open condition, in dependence on and coordination with actuation of said ignition system, whereby to permit a jet of said pressurized fuel to flow out from said nozzle towards said burning space.

It is an object of the present invention to provide a lighter device of the forementioned general type which will avoid the deficiencies of the known devices of the prior art; particularly, the device should be of a more rugged construction and hence easy to manufacture at relatively low cost, should have increased reliability of operation over an extended period of useful life, and should provide a strong flame and have particular wind-proof capabilities. In a lighter device of the forementioned type provision is made in accordance with the present invention that, said burning system comprises a combined tube-like vaporizer-and-burner unit axially aligned with the nozzle-and-valve aggregate, said tube-like vaporizer-and-burner unit is vertically positioned with its lower end at a predetermined distance above said nozzle-and-valve aggregate and cleared therefrom by said distance, the lower end of said tube-like vaporizer-and-burner unit has a diameter larger than the diameter of said nozzle.

Thus, in accordance with one basic feature of the present invention, the short tube vaporizer and burner unit is provided as a separate member mounted separately and independent from the nozzle valve; thus there is no direct mechanical connection and correspondingly no direct heat conduction or heat transfer between the burner unit and the nozzle and valve aggregate, whereby impairment of the latter by heat form the burner unit is effectively avoided or diminished. At the same time, there will be no undue limitation on the size and temperature admissible for the flame which therefore can be a strong, hot, blue-color flame which in itself has a substantial wind-proof capability. The strong flame is also enabled by the fact that the lower end of the vaporizer-and-burner unit arranged in a predetermined distance above the nozzle has a larger diameter than the nozzle whereby the jet stream flowing out from the nozzle will be substantially completely received in the lower end of the vaporizer unit and simultaneously will draw ambient air into the vaporizer-and-burning unit thereby intensely mixing and vaporizing the butane gas/air mixture.

In accordance with a further important feature of the present invention, said combined tube-like vaporizer-and-burner unit is partitioned into two axially aligned compartments by a horizontally extending perforated partition wall, preferably a piece of perforated metal sheet. This perforated metal sheet effectively further intensely mixes and vaporizes the butane/air mixture, thus providing for a particularly efficient type of "turbo-burning".

In accordance with a further important feature of the present invention, a catalyzer wire is provided within said tube-like combined vaporizer-and-burner unit in the upper section thereof. Thereby, In case the lighter flame previously ignited would become extiguished by a strong wind or some other cause, the heated catalyzer wire will automatically re-ignite fresh vaproized butane/air-mixture which continues to be fed into the vaporizer-and-burner unit as long as the actuating member of the nozzle valve unit is kept pressed down in its actuated state.

Generally the invention provides for a simple to manufacture lighter which will provide reliable operation over an extended long useful life, and has improved wind-proof characteristics by an automatic re-igniting capability.

DETAILED DESCRIPTION OF THE PREFERRED EMBODIMENTS

Figure 3:
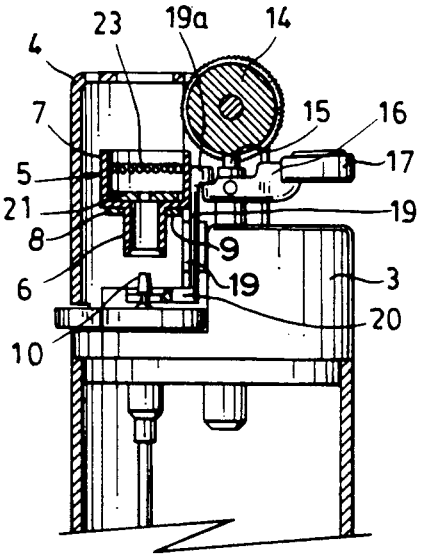
FIG. 1 through 3 are side elevational views of a first embodiment of a lighter in accordance with the invention, with FIG. 2 and 3 being partially sectioned to show details of the inner structure of the device.

In the preferred embodiments described the lighter of the present invention comprises, in a manner generally known, a lower portion generally designated at 1 and an upper portion generally designated at 2. Lower portion 1 in a conventional manner forms, or contains, the tank for the fuel used, preferably liquid butane gas under pressure, or some other conventional lighter fuel. The lighter upper portion 2 comprises an upper seat member 3 mounting the (conventional) ignition and actuation mechanisms and the nozzle and valve mechanism to be described further below, as well as wind shield 4 mounting and enclosing the specific vaporizer and burner members of the present invention to be described hereinafter.

The vaporizer and burner unit of the present invention is in the form of a short metal tube member generally designated at 5. Vaporizer and burner unit 5 in the preferred embodiment as shown and described consists of two relatively short tube sections 6, 7 arranged coaxially with one another, one above the other along a common axis. Preferably, the two sections 6, 7 form a unitary structure.

Figure 6:
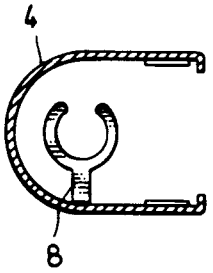
FIG. 6 is a sectional top view of the wind shield showing the mounting or holding member for the burning system.

The aforementioned unitary vaporizer and burner structure 5 is mounted on wind-shield 4, by means of a horseshoe-shaped mounting or holding member 8 which as is best seen in FIG. 6 horizontally extends inwardly from the inner wall of windshield 4, and accommodates, with its horseshoe-shaped portion, the vaporizer and burning unit 5 at a predetermined position hereinafter described. In the preferred embodiment shown, the two tube sections 6,7 of the short metal tube 5 have different diameters, the upper tube section 7 having a larger diameter than the lower tube section 6, whereby a step 9 is formed at the junction of the two tube sections. Horizontal step 9 thus formed provides a convenient mounting face which rests upon, and is affixed to, the horse-shoe-shaped portion of mounting and holding member 8.

The (substantially conventional) nozzle and valve unit 10 is arranged in the upper portion of the left part (as shown in the drawing) of upper seat member 3, with unit 10 projecting from and above the upper end of said left part of the upper seat member. A conventional flow regulator 11 for controlling the flow volume of liquid butane gas passing through nozzle 10 in its open condition and thus regulating the size of the flame, is associated with the nozzle and valve unit 10 and projects horizontally from the side wall of the lighter casing, for actuation by the user to control the flow volume and thereby the size of the flame.

The (substantially conventional) ignition and actuation mechanisms are mounted on the right hand portion (as shown in the drawings) of upper seat member 3. In the embodiment shown in FIG. 1 through 8, the ignition mechanism is of the well-known mechanical type comprising a hand-actuated ignition wheel or drum and flint arranged for cooperation therewith. As can be seen more clearly from the top view shown in FIG. 4 the ignition wheel or drum comprises two knurled end sections 12, 13 of slightly larger diameter for actuation by the user, and a main section 14 of slightly smaller diameter and having a suitably roughened surface to strike ignition sparks from a flint stone 15 arranged to cooperate with the ignition wheel, on actuation thereof. The ignition wheel or drum slightly projects from the upper end of windshield 4, for actuation by the user, and flint stone 15 is preferably arranged below the horizontally mounted ignition wheel or drum so that ignition sparks when generated on actuation of the wheel or drum will be directed towards the upper end of vaporizer and burner unit 5 within windshield 4.

Figure 2:
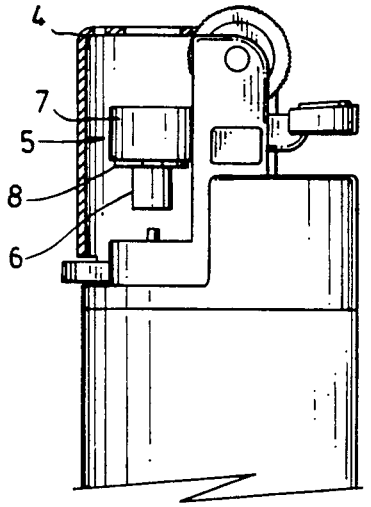
Figure 1:
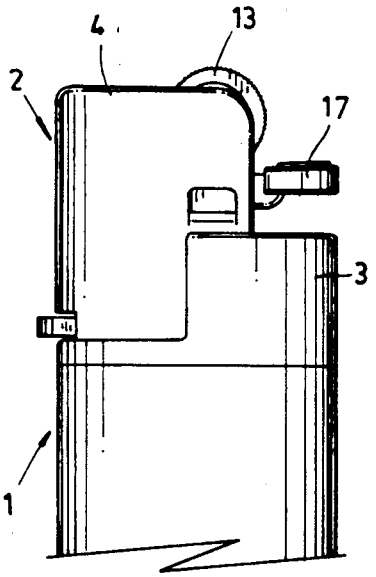
Figure 4:
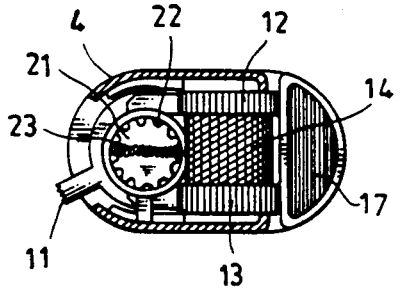
FIG. 4 shows a top end view of the lighter device of FIG. 1 through 3, partially sectioned.
Figure 5:
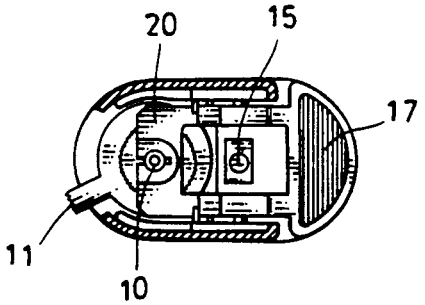
FIG. 5 shows the same lighter device in a partially sectioned top end view similar to FIG. 4, with the ignition wheel and parts of the burning system being omitted to show the parts therebelow.
Figure 8:
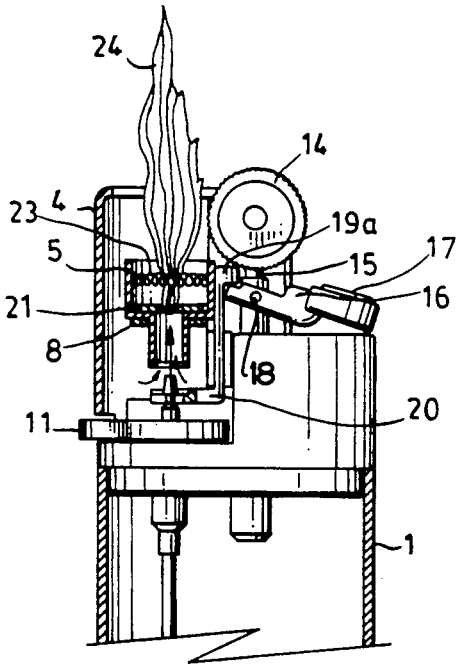
FIG. 8 shows the same embodiment of the lighter in a partially sectioned elevational side view similar to FIG. 3, with the actuator for the valve being in its actuated or depressed position and with the flame burning on top of the vaporizer-and-burner unit.

The (substantially conventional) actuating mechanism for nozzle and valve unit 10, in the embodiment described comprises an actuating lever 16 pivotably mounted below the ignition wheel and flint stone 11, 15 and substantially extending horizontally. At its right end (as shown in the figures) actuating lever 16 is provided with a larger actuating portion 17 suitably associated with ignition wheel or drum 11 in such a manner that if the user actuates ignition wheel 11, with the thumb of the hand holding the lighter, the thumb will press upon actuating portion 17 of lever 16 to cause lever 7 to pivot from the substantially horizontal normal or rest position shown in FIGS. 1, 2 and 3, into the actuated position shown in FIG. 8 where actuating lever 16 is shown pivoted in a clock-wise direction about its pivot 18. At its end opposite actuation portion 17, actuation lever 16 pivotably engages with the upper end 19*a* on the vertical arm of a substantially L-shaped bracked 19, the lower substantially horizontal arm 20 of which engages with the nozzle and valve unit 10 for actuation thereof between a closed valve condition as shown in FIG. 1 through 3 and an open valve condition as shown in FIG. 8.

In accordance with one basic feature of the present invention, the short-tube vaporizer and burner unit 5, with its vertical longitudinal axis aligned with nozzle and valve unit 10, is arranged vertically such that the lower end of unit 5 (i.e. the lower end of the lower tube section 6 of unit 5) will be at a predetermined height above unit 10. Thus there will be no direct mechanical connection between the nozzle and valve unit 10 and (the lower end of) vaporizer and burning unit 5, and correspondingly no direct heat conduction or heat transfer between burner unit 5 and nozzle and valve unit 10.

In accordance with another important feature of the present invention, the diameter of the lower end 6 of vaporizer and burner unit 5 will be larger than the diameter of unit 10 of the butane gas tank whereby the (liquid) butane gas jet ejected from unit 10 (in the actuated open valve condition thereof) on its way upward into vaporizing and burner unit 5 will draw a stream of ambient air into unit 5, for intensive mixing with, and vaporizing of, the butane gas stream in the lower part of unit 5.

In this connection, in accordance with a further important feature of the present invention, a piece of perforated metal sheet 21 is provided horizontally at the junction between the upper and lower sections 7, 6 of unit 5. This perforated metal sheet is best shown in FIG. 3, and the perforations 22 are best shown in the enlarged top view of FIG. 7. This perforated metal sheet effectively further causes intense mixing and vaporization of the butane-air mixture, thus providing for a particularly efficient type off "turbo"-burning.

Further, in connection with an additional basic feature of the present invention, a catalyzer wire 23 is provided centrally in the upper section 7 of burner unit 5. The catalyzer wire 23 may be in the form of a wire spring as shown in FIG. 3, or as a wire net or in some other similar equivalent form allowing substantially uninhibited flow of the vaporized gas/air mixture while providing for a distributed contact with such stream. Thereby, in case the lighter flame previously ignited should become extinguished by wind or some other cause, the flame would automatically be re-ignited by the contact between the (hot) wire or net 23 in contact with the fresh vaporized gas/air mixture continuing to flow upwards, as long as actuating member 17 is maintained in its depressed position corresponding to the open-valve-condition of nozzle unit 10.

As mentioned, in accordance with a basic feature of the present invention vaporizer and burner unit 5 is arranged vertically at a predetermined vertical distance above nozzle 10. On the other hand, vaporizer and burning unit 5 is vertically positioned such that its upper end is in the vicinity of the ignition sparks travelling in a substantially horizontal tangential direction from the point of contact between flint stone 15 and the ignition wheel or drum.

Thus, in the lighter of the present invention, the burning space substanially will be at the upper end 7 of unit 5, and thus will be as far removed as possible from the delicate nozzle and valve unit 10. Additionally, as there is no direct heat conducting mechanical connection between vaporizer and burner unit 5 and the nozzle valve unit 10, the latter will be effectively protected against heat from the burner or the flame.

The operation of the lighter device of the present invention will be obvious from the description above and can be summarized as follows:

Actuation of the ignition wheel or drum will cause the generation of ignition sparks from flint stone 15 cooperating with the wheel or drum, said ignition sparks being directed towards the (upper end of) vaporizer and burner unit 5. The simultaneous actuation, by the user, of actuating lever 17 will cause nozzle valve unit 10 to open whereby a jet of liquid butane will flow out from nozzle 10, and its high velocity stream will draw surrounding ambient air (oxygen) into the lower part 6 of vaporizer and burner unit 5. Vaporization of the butane liquid gas and mixing thereof with the air sucked into the lower end 6 of unit 5 will continue within the lower part 6 of unit 5 and will be further intensified and continued during the passage of the mixture through the holes 22 of perforated metal sheet 21 and during further passage of the mixture through the upper part 7 of unit 5. On reaching the upper end 7 of unit 5, the fully and intensely mixed vaporized butane/air (oxygen) mixture will be ignited by the ignition sparks from flint 15 and will burn in a strong, stable, hot blue-color flame 24, as indicated in FIG. 8.

If flame 24 should happen to be extinguished by a strong wind or some similar exterior cause, the heated wire catalyzer 23 provided in the upper part 7 of unit 5 will automatically re-ignite fresh vaporized butane/air-mixture which continues to be fed from the nozzle at the lower part of unit 5, as long as actuating member 17 is kept in its pressed actuated state.

The invention thus provides for a simple to manufacture lighter which will provide reliable operation over an extended long useful life, and with improved windproof characteristics by an automatic re-igniting capability.

Figure 9:
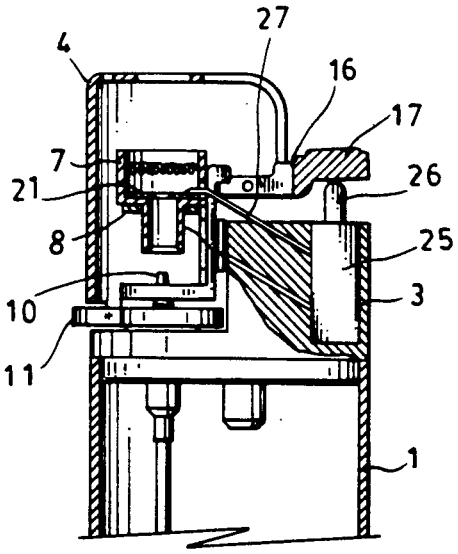
FIG. 9 is a partially sectioned elevational side-view of another embodiment of the invention using a piezoelectic ignition unit instead of the flint stone ignition unit in the embodiment FIG. 1 throuh 8.
Figure 7:
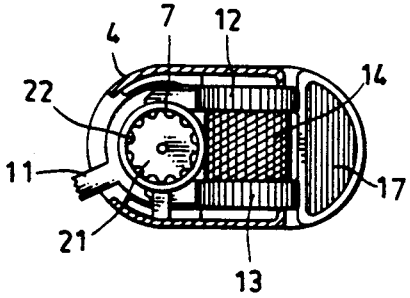
FIG. 7 is a partially sectioned top end view similar to FIG. 4, with the catalyzer wire in the upper section of the burning unit being omitted to show the perforated partition wall with holes therein.

The embodiment described thus far in connection with FIGS. 1 through 8 utilizes a conventional ignition drum/flint stone-ignition system. However, the present invention can employ other ignition systems, such as a piezoelectric unit ignition system known per se. An embodiment of this type is shown in FIG. 9, wherein the same or similar parts are designated with the same reference numerals as in FIG. 1 through 8. The FIG. 9 embodiment differs from the FIGS. 1 through 8 embodiment by the utilization of a piezoelectric type ignition system instead of the flint stone ignition system. As shown in FIG. 9, a suitable piezoelectric unit 25 is mounted in the right-hand part (as shown in FIG. 9) of the upper seat member 3, below and suitably aligned with actuating lever 16, 17. An actuating member 26 for the piezoelectric unit 25 is associated with actuating lever 16, 17 whereby piezoelectric unit 25 will be actuated if actuating lever 16, 17 is pressed down for actuation of the lighter.

The electrical output lines 27 of the piezoelectric unit 25 are suitably connected with parts in the vaporizer-and-burner unit 5, whereby a spark will be generated within unit 5 on actuation of piezoelectric unit 25, and the gas/air mixture passing through unit 5 will be ignited to form a strong flame burning on top of section 7 of unit 5.

What is claimed:

1. A lighter device comprising a lower housing portion housing a fuel tank containing pressurized butane liquid gas fuel under pressure, an upper portion of the lighter including a burning space, a nozzle and valve unit connected with said fuel tank and projecting from said lower housing portion toward said burning space, said nozzle having a diameter, a burning system including a tube-like burner means supported above said nozzle and valve unit, an ignition system mounted on the upper portion of the lighter to provide ignition sparks to said burning space, actuating means for switching the valve from a normally closed condition to an open condition allowing fuel to flow therefrom said tube-like burner means comprising a unitary structure having upper and lower short-tube sections of different diameters axially aligned with one another and being axially aligned with said nozzle and valve unit, said tube-like burner means having a lower end spaced a predetermined distance above said nozzle and valve unit, and said lower section having a diameter larger than the diameter of said nozzle.

2. A lighter as defined in claim 1 wherein said upper tube section has a larger diameter than said lower tube section.

3. A lighter as defined in claim 1 wherein said tube-like burner means is partitioned into two axially aligned compartments by a horizontally extending perforated partition wall.

4. A lighter as defined in claim 1 wherein said partition wall is formed of perforated sheet metal.

5. A lighter as defined in claim 1 including a catalyzer wire provided within the upper portion of said tube-like burner means.

6. A lighter as defined in claim 1 wherein said actuating means comprises an actuation lever pivotally mounted on the upper portion of the lighter, and movable linkage operatively connecting said actuation lever with the valve of said nozzle and valve unit.

7. A lighter as defined in claim 1 wherein said ignition system comprises an ignition wheel and cooperative flint arranged to direct ignition sparks towards the upper end of said tube-like burner means.

8. A lighter as defined in claim 1 wherein said ignition system comprises a piezoelectric unit, said actuating means substantially simultaneously actuating said piezoelectric unit and opening said valve.

9. A lighter device comprising a lower housing portion housing a fuel tank containing pressurized butane liquid gas fuel under pressure, an upper portion of the lighter including a burning space, a nozzle and valve unit connected with said fuel tank and projecting from said lower housing portion toward said burning space, said nozzle having a diameter, a burning system including a tube-like burner means supported above said nozzle and valve unit, an ignition system mounted on the upper portion of the lighter to provide ignition sparks to said burning space, actuating means for switching the valve from a normally closed condition to an open condition allowing fuel to flow therefrom and operating said ignition system to provide ignition sparks upon actuation of said actuating means, said tube-like burner means being axially aligned with said nozzle and valve unit, said tube-like burner means having a lower end spaced a predetermined distance above said nozzle and valve unit, said lower end having a diameter larger than the diameter of said nozzle, a wind shield disposed at the upper portion of the lighter and enclosing said burning space, a mounting member supported by said wind shield and extending inwardly therefrom, said mounting member being a horseshoe-shaped member, said tube-like burner means including an upper tube section and a lower tube section of different diameters, said lower tube section being of smaller diameter than said upper tube section, said horseshoe-shaped member receiving said lower tube section to mount said burner means in operative position.

* * * * *